US008820473B1

(12) United States Patent
White

(10) Patent No.: US 8,820,473 B1
(45) Date of Patent: Sep. 2, 2014

(54) GAS DISPERSION NOZZLE FOR A FIRE ARM SILENCER

(71) Applicant: Mark White, Nordland, WA (US)

(72) Inventor: Mark White, Nordland, WA (US)

( * ) Notice: Subject to any disclaimer, the term of this patent is extended or adjusted under 35 U.S.C. 154(b) by 0 days.

(21) Appl. No.: 13/772,206

(22) Filed: Feb. 20, 2013

(51) Int. Cl.
*F41A 21/30* (2006.01)
*F41A 21/34* (2006.01)

(52) U.S. Cl.
CPC ..... *F41A 21/30* (2013.01); *F41A 21/34* (2013.01)
USPC ..... 181/223; 89/14.4

(58) Field of Classification Search
CPC ..... F41A 21/30
USPC ..... 181/223; 89/14.4
See application file for complete search history.

(56) References Cited

U.S. PATENT DOCUMENTS

| | | | | |
|---|---|---|---|---|
| 4,384,507 | A * | 5/1983 | Finn | 89/14.4 |
| 4,576,083 | A * | 3/1986 | Seberger, Jr. | 89/14.4 |
| 4,649,798 | A | 3/1987 | Phillips | |
| 4,920,854 | A | 5/1990 | Scanlon | |
| 7,073,426 | B1 | 7/2006 | White | |
| 7,207,255 | B2 | 4/2007 | Felton et al. | |
| 7,308,967 | B1 * | 12/2007 | Hoel | 181/223 |
| 7,987,944 | B1 | 8/2011 | Brittingham et al. | |
| 8,096,222 | B2 * | 1/2012 | Silvers | 89/14.4 |
| 8,100,224 | B1 | 1/2012 | Olson | |
| 8,162,100 | B2 | 4/2012 | Shults et al. | |
| 8,167,084 | B1 | 5/2012 | Moore | |
| 8,292,025 | B1 | 10/2012 | Woodell et al. | |
| 8,307,946 | B1 | 11/2012 | Johnston | |
| 8,322,266 | B2 | 12/2012 | Presz, Jr. et al. | |
| 2010/0163336 | A1 * | 7/2010 | Presz et al. | 181/223 |
| 2011/0067950 | A1 * | 3/2011 | Shults et al. | 181/223 |
| 2012/0152093 | A1 | 6/2012 | Koumbis | |
| 2012/0152649 | A1 * | 6/2012 | Larue | 181/223 |
| 2012/0180624 | A1 | 7/2012 | Troy et al. | |
| 2012/0272818 | A1 * | 11/2012 | Dueck et al. | 89/14.4 |
| 2012/0273297 | A1 | 11/2012 | Schlosser | |
| 2012/0291614 | A1 | 11/2012 | Koumbis | |

OTHER PUBLICATIONS

YHM Muzzle Brake https://yhm.net/phantom-5-56-comp-brake-q-d-mount.html.

* cited by examiner

*Primary Examiner* — Jeremy Luks
(74) *Attorney, Agent, or Firm* — Gerald M. Walsh; The Leo Law Firm

(57) ABSTRACT

A gas dispersion nozzle for a gun silencer having a nozzle portion with a front end and a rear end and walls enclosing a hollow interior therein. The rear end of the nozzle portion is attached to the gun silencer and the nozzle portion extends into the interior of the gun silencer. The rear end also attaches to a firearm. The walls have channels which direct flow of propellant gases out of the hollow interior and into the interior of the gun silencer at an angle to a path along which the projectile passes when the firearm is discharged. The channels cause the flow of propellant gases to become turbulent or rotational or both and can cause the flow rate of said propellant gases to decrease. The gas dispersion nozzle reduces the report and/or flash produced by the discharge of a firearm.

22 Claims, 5 Drawing Sheets

GAS DISPERSION NOZZLE FOR A FIRE ARM SILENCER

FIELD OF THE INVENTION

The invention relates to firearm silencers and, more particularly, to a vented chamber or gas dispersion nozzle, placed between a firearm's barrel and a firearm silencer, to direct high-pressure propellant gases perpendicular to the firearm's bore, thereby adding greatly to the silencer's overall efficiency in reducing both the report and flash produced by the propellant gases.

BACKGROUND OF THE INVENTION

It is well known that when a firearm is discharged, jets of gas are formed within the barrel muzzle due to the expansion of gases upon detonation of the cartridge. Additionally, jets of gas are also formed as the bullet is propelled forward through the barrel, caused by the compression of gases in front of the bullet as it moves forward. Flash is caused by the incomplete combustion of gases as they exhaust from the barrel. Specifically, when a weapon is fired, the gases released are typically still burning when they exhaust from the barrel. As such, a "flash" of light can commonly be seen as these gases dissipate and burn off. Muzzle blast (sound) is caused by a shockwave exiting the weapon's barrel. It is also known that turbulence of the hot gases in the chamber of a silencer also increases the dwell time of the gases within the silencer, allowing the further combustion of gases. Accordingly, when these gases exit the gun silencer the amount of flash is reduced.

As technical advances in the firearm silencer industry increase, competition for greater effectiveness in smaller silencer systems has also increased. The area where propellant gas release pressure (and discharge noise) is the highest resides at the muzzle of a barrel, in the rearmost portion of a silencer. Any release of gas that exceeds the speed of sound (roughly 1,100 feet per second, or FPS) will make a loud sound (sonic crack) as the gas is released into the atmosphere. Under some conditions the sound can be heard up to four miles away. The speed of released gases from typical U.S. military rifles (0.223 and 0.308) is roughly 16,000 FPS, well beyond the speed of sound.

One of the common difficulties with silencers is a phenomenon called first round pop wherein the first shot in a series will be notably louder than the rest. This occurs because oxygen in the air (air is roughly 20% oxygen) within a silencer body will combine with superheated, unburned gaseous components in hot propellant discharge and reignite, causing a report that is significantly louder than subsequent reports from shots fired within a following minute or two. In a military setting the first shot should be the most quiet, not the loudest.

Pressure at the muzzle of some firearms can reach 20,000 PSI (pounds per square inch), at which point the propellant gas tends to behave more like a liquid than like a gas. The gas has increased weight and velocity, like a moving liquid under high pressure, but it also expands, like a gas. Propellant gas which is released at a firearm's muzzle also produces an electrical event, where billions of free electrons are suddenly released into the atmosphere, causing a visible flash. The propellant gas release also emits a strong burst of electrical energy and a powerful burst of radio waves. The visible flash of light is enhanced when hot, ionized propellant gas mixes its flame front with free oxygen in air, allowing unburned combustion products to reignite.

Once the propellant gases have slowed below 1,100 FPS their lessened release velocity will not cause a loud sound or sonic crack. A visible flash of light may not be totally extinguished, but it will be greatly diminished with an effective baffling system within the silencer chamber. What is needed is a more effective way to turbinate (spin rapidly, in a volute curve) the released propellant gases within the confines of a silencer's shell or container, and to capture and slow the release of propellant gases into the atmosphere to prevent a sonic crack and visible flash. This should be accomplished in such a way that will allow the use of smaller silencers compared to the size of silencers presently required to reduce sound and flash.

SUMMARY OF THE INVENTION

The present invention is a gas dispersion nozzle for a gun silencer having a nozzle portion with a front end and a rear end and walls enclosing a hollow interior therein through which a projectile and propellant gases pass. The rear end of the nozzle portion has a base portion attached thereto constructed to attach the nozzle portion to the gun silencer and to extend the nozzle portion into an interior of said gun silencer. The base portion is also constructed to attach the nozzle portion to a barrel of a firearm. The base portion has walls enclosing a hollow interior therein through which a projectile and propellant gases pass. The walls of the nozzle portion having channels which direct the flow of the propellant gases out of the hollow interior of the nozzle portion at an angle to a path along which the projectile passes. These channels in the nozzle portion cause the flow of the propellant gases to become turbulent or rotational or both, and they decrease the flow rate of the propellant gases. The nozzle portion may have an internal choke at the front end of the nozzle portion to direct the propellant gases into the channels of said nozzle portion. This nozzle portion decreases the report and/or flash produced by the discharge of a firearm as a result of the decrease in flow rate of propellant gases when they pass through the side channels in the nozzle portion.

In an alternate embodiment, the rear end of the nozzle portion has a threaded extension attached thereto which attaches the nozzle portion to a gun silencer and extends the nozzle portion into an interior of the gun silencer. The threaded extension also attaches the nozzle portion to a barrel of a firearm. The threaded extension allows extension of the nozzle portion into the interior of the gun silencer off center of the interior of said gun silencer, if desired. The walls of this nozzle portion also have channels which direct the flow of the propellant gases out of the hollow interior at an angle to a path along which said projectile passes and into the interior of the gun silencer. Accordingly, this nozzle portion causes turbulent or rotational flow of propellant gases and decreases the report and/or flash produced by the discharge of said firearm.

Preferably, the gas dispersion nozzle is attached at the rear end of its nozzle portion to a gun silencer in which the interior of the gun silencer has one or more slant baffles and one or more blast baffles. The blast baffle has angled grooves to cause the flow of the propellant gases to become rotational, thereby decreasing the flow rate of the propellant gases through the interior of the gun silencer. In this arrangement, when the gas dispersion nozzle is used with a gun silencer it can increase the efficiency of the gun silencer in reducing sound and flash by 20% to 60%. When the blast baffle, with angled grooves, is used with a gun silencer it can increase the efficiency of the gun silencer in reducing sound and flash by 10% to 40%. When both the gas dispersion nozzle and the blast baffle are used together with a gun silencer they can increase the efficiency of the gun silencer in reducing sound and flash by 30% to 90%. In addition, the combination of the gas dispersion nozzle and the blast baffle in the gun silencer can reduce the flow rate of propellant gases below the speed of sound as the propellant gases exit the front end of the silencer.

An advantage of the gas dispersion nozzle of the present invention is the reduction or elimination of the report and/or flash produced by propellant gases produced by the discharge of a firearm.

Another advantage is a gas dispersion nozzle that attaches easily to a gun silencer and to the muzzle of a firearm, either with a common thread system or with a quick release threaded coupling using an Acme thread, common throughout the industry.

Another advantage is a gas dispersion nozzle that allows the use of smaller gun silencers.

Another advantage is that the first round pop is greatly diminished or eliminated.

Another advantage is a gas dispersion nozzle that is relatively small and easy to manufacture.

Another advantage is that when the gas dispersion nozzle is used in a gun silencer having slant baffles and a blast baffle with angled grooves, the flow rate of propellant gases can be reduced below the speed of sound as the propellant gases exit the front of the gun silencer.

DETAILED DESCRIPTION OF THE INVENTION

While the following description details the preferred embodiments of the present invention, it is to be understood that the invention is not limited in its application to the details of construction and arrangement of the parts illustrated in the accompanying figures, since the invention is capable of other embodiments and of being practiced in various ways.

Gun silencers for self-loading pistols with moving barrels using Neilson adaptors (essentially vented or non-vented pistons that kick moving barrels into opening their actions to ensure reliable self-loading) are known; however, the use of the small fixed chamber of the present invention, placed at the muzzle of a firearm barrel for the purpose of redirecting propellant gases to the side, or in a volute curve, within the gun silencer chamber, are not known in the silencer industry.

Vent holes placed in the end of such a chamber can be directly perpendicular to a bullet's path, or they can be angled to induce a rotary (clockwise or counterclockwise) centrifugal, volute movement within the larger containment of a silencer's body. Clockwise movement from these vents (when viewed from the rear of the firearm) will also tend to tighten a silencer that uses right-hand attachment threads on its barrel.

A dispersion nozzle of this invention with these vents can be part of a silencer's mounting system or it can be a separate system that involves a muzzle brake or a flash hinder that connects a firearm's barrel to the rear of a silencer. An objective of the nozzle is to capture released gases, and then allow them to vent directly into the rear of a silencer's chamber in a direction at an angle, preferably perpendicular, to a bullet's flight path. The nozzle is constructed to have the vent holes in the nozzle sized proportionately to produce maximum turbulence and delay of the propellant gases, whether the gases strike the internal walls of the silencer perpendicularly, or swirl in a volute curve within the nozzle and/or the silencer chamber.

The primary benefit of the chamber/nozzle system of the present invention is a rapid diversion of the blast of propellant gas coming from a firearm's muzzle. The dramatic change of direction and breakup of this blast causes heat and gas movement to be diminished, which in turn allows baffles in a gun silencer downstream from this device to do their job more effectively. This in turn allows the use of a silencer with a smaller body and shorter overall length to accomplish the same reduction of flash and report, yielding a smaller, lighter, more efficient silencer unit.

A secondary benefit of the chamber/nozzle system is that the first round pop is greatly diminished by turbinating the propellant gas mixture vigorously, thus preventing a flame front from causing a secondary combustion when air instead of spent gases remains within various internal chambers.

Figure 1:
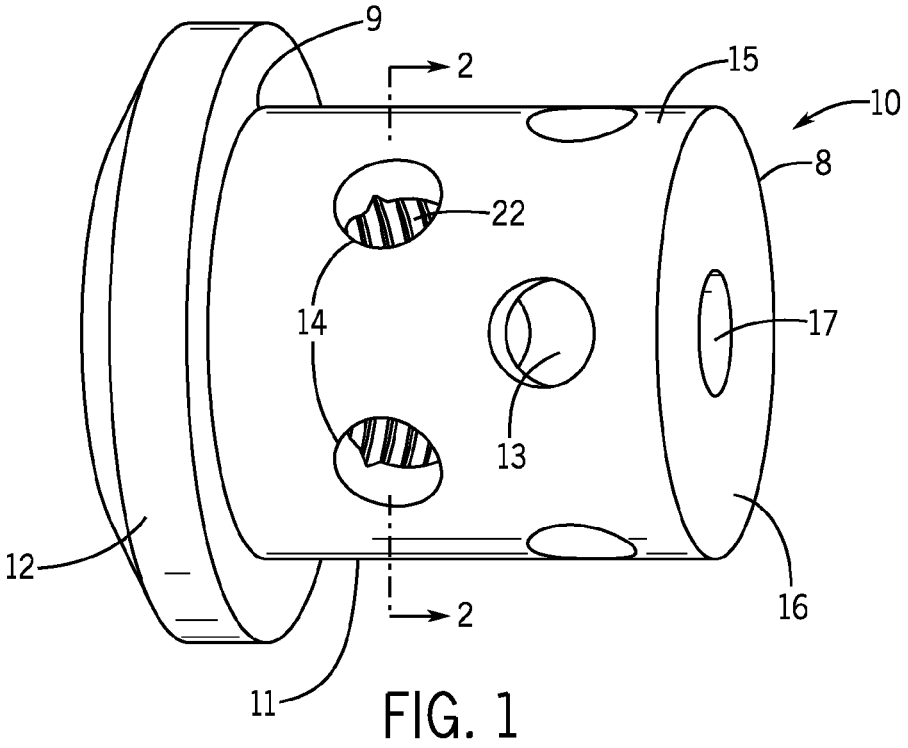
FIG. 1 shows a perspective view of the gas dispersion nozzle of the present invention.

FIG. 1 shows the gas dispersion nozzle 10 which has a nozzle portion 11 and a base portion 12, wherein the nozzle portion 11 has a front end 8 and a rear end 9. The base portion 12 is attached at one end to the nozzle portion 11 near the rear end 9 of nozzle portion 11. The gas dispersion nozzle 10 is shown as circular having walls 15 which define a hollow interior 13 within. The gas dispersion nozzle 10 could also take other geometric forms, such as square, rectangular, hexagonal, etc. The front face 16 of the nozzle portion 11 has an exit opening 17. Holes or channels 14 extend from the hollow interior 13 through the walls 15 of the gas dispersion nozzle 10.

Figure 2:
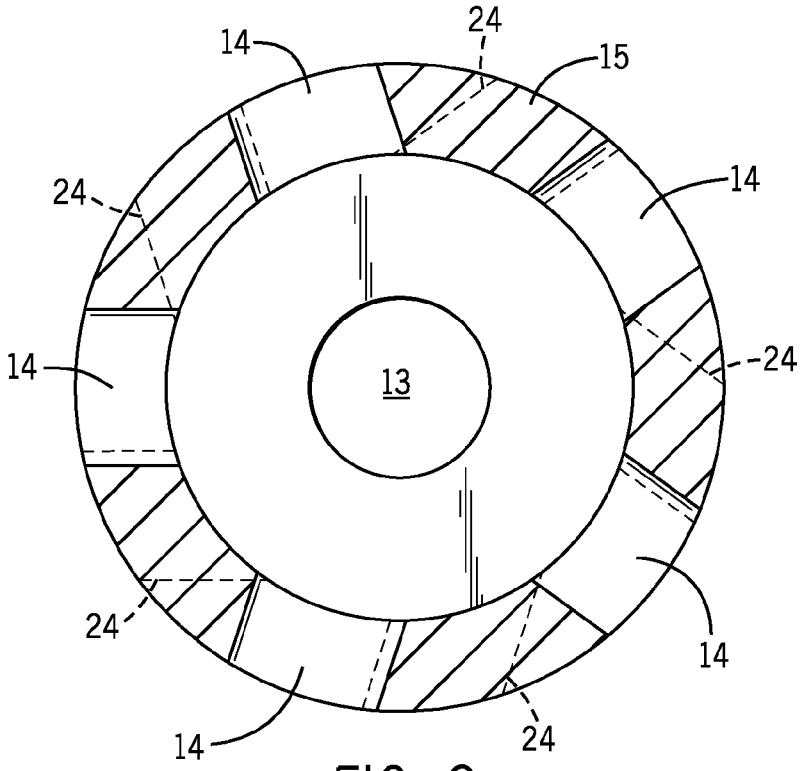
FIG. 2 shows a cross section view of the nozzle portion along line 2 in FIG. 1.

FIG. 2 shows a cross section view of the nozzle portion 11 along line 2 in FIG. 1. FIG. 2 illustrates that channels 14 extend through walls 15 in a perpendicular orientation to the hollow interior 13, or its longitudinal axis. When the propellant gases are expelled through channels 14 their flow rate becomes turbulent and the flow rate decreases. FIG. 2 further illustrates that other channels 24, shown in dotted lines, can be angled with respect to the hollow interior 13, or its longitudinal axis, as shown. When the propellant gases are expelled through the angled channels 24 they will rotate and/or create a vortex. This rotational flow also decreases the rate of flow of the gases.

Figure 3:
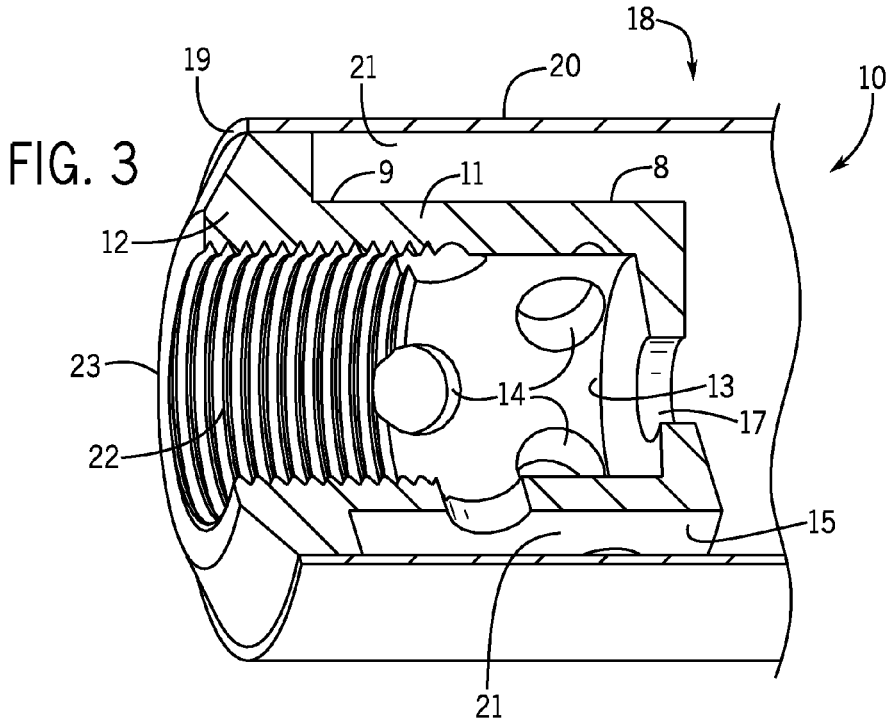
FIG. 3 shows a cutaway view of the gas dispersion nozzle attached to the rear end of a gun silencer.

FIG. 3 shows a cutaway view of the gas dispersion nozzle 10 attached to the rear end 19 of a gun silencer 18. FIG. 3 further illustrates that the gun silencer 18 has an outer casing 20 which defines an interior 21 of the gun silencer 18, and that the nozzle portion 11 projects into the interior 21 of the gun silencer 18. The base portion 12 has an entrance opening 23 and the surface of the hollow interior 14 of the base portion 12 has threads 22 which engage threads of a threaded hollow extension attached to the muzzle of a firearm barrel (see FIG. 4). Threads 22 may extend into the hollow interior 14 of the nozzle portion 11. Although the gun silencer 18 is shown as cylindrical in shape it could also take other geometric forms, such as square, rectangular, hexagonal, etc.

Figure 4:
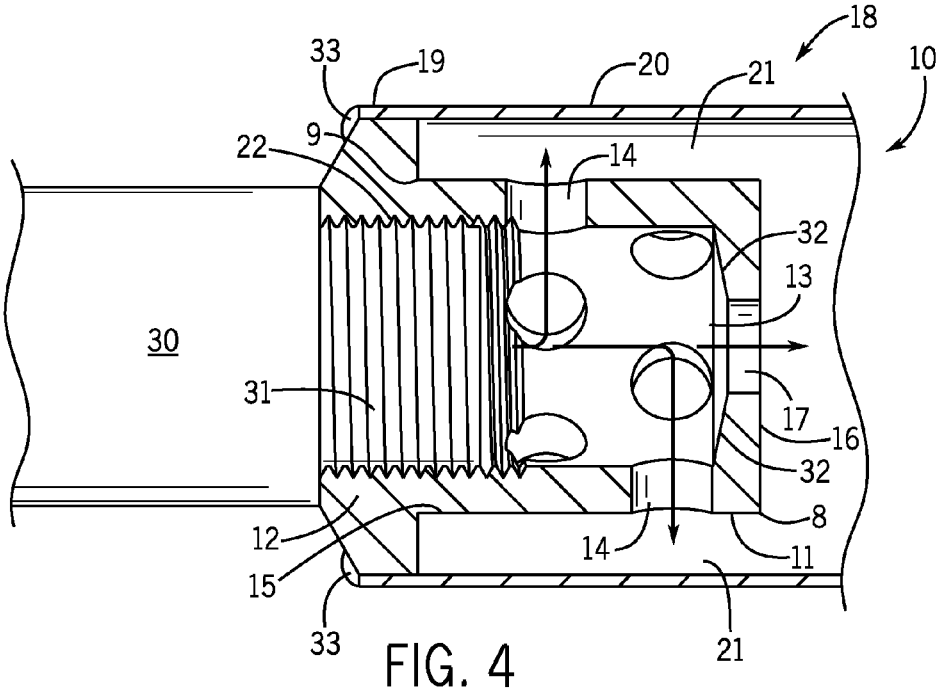
FIG. 4 shows a sectional view of the gas dispersion nozzle attached to the rear end of a gun silencer and to a threaded hollow extension attached to the muzzle of a firearm barrel.

FIG. 4 shows a sectional view of the gas dispersion nozzle 10 attached to the rear end 19 of a gun silencer 18 and to a threaded hollow extension 31 attached to the muzzle of a firearm barrel 30. The gas dispersion nozzle 10 is attached by its base portion 12 to the gun silencer 22 by methods well known in the art, preferably by welding it in place, indicated by the welding joints 33. The gun silencer may also be attached by soldering or threading. The front end 8 of the nozzle portion 11 may have an internal choke 32. The dotted arrows show the paths of the propellant gases from the firearm barrel 30 and threaded extension 31 through the channels 14 and the exit opening 17.

A projectile from a discharge of the fire arm will pass through the hollow interior 13 of the threaded extension 31 on the firearm muzzle, through the interior 13 of the gas dispersion nozzle 10, out through the opening 17 of the nozzle portion 11, and through the interior 21 of the gun silencer 18. The propellant gases will follow a similar path but, in addition, a portion of these gases will also pass through the channels 14 and into the interior 21 of the gun silencer 18. The channels 14 are oriented 90 degrees to the path of the projectile. As a portion of the gases pass through the channels 14, the laminar flow of these gases is converted into a turbulent flow, thereby decreasing the rate of flow of these gases and prolonging the duration of time these gases are contained within the gun silencer interior 21. The longer the duration of the gases in the interior 21 of the gun silencer 18 the greater the degree of the combustion of the gases. The internal choke 32 helps direct the gases through channels 14. Decreasing the rate of flow of the gases in this manner can reduce or eliminate the loud sound and flash that can occur as the gases exit the gun silencer 22. The gas dispersion nozzle 10 is most effective when used with the gun silencer described in my patent, U.S. Pat. No. 7,073,426, dealing with slant baffles and a bullet-stabilizing blast baffle, but can be used with other baffle systems as well.

Figure 5:
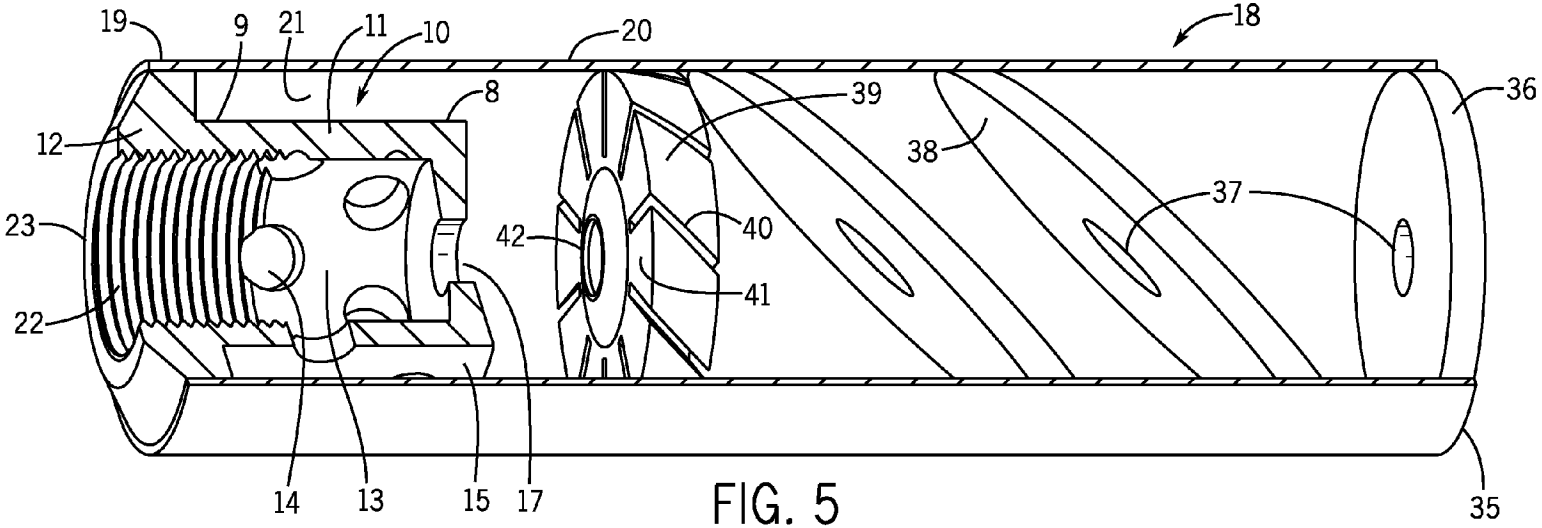
FIG. 5 shows a cutaway view of the gas dispersion nozzle positioned in a gun silencer.
Figure 6:
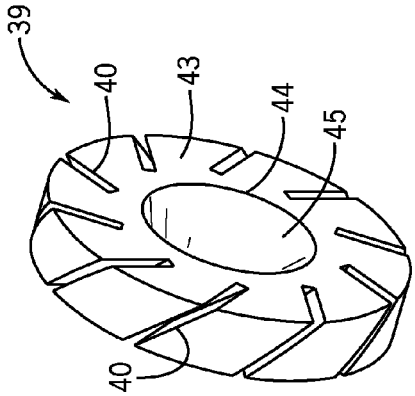
FIG. 6 shows an enlarged view of the blast baffle having angled grooves.
Figure 7:
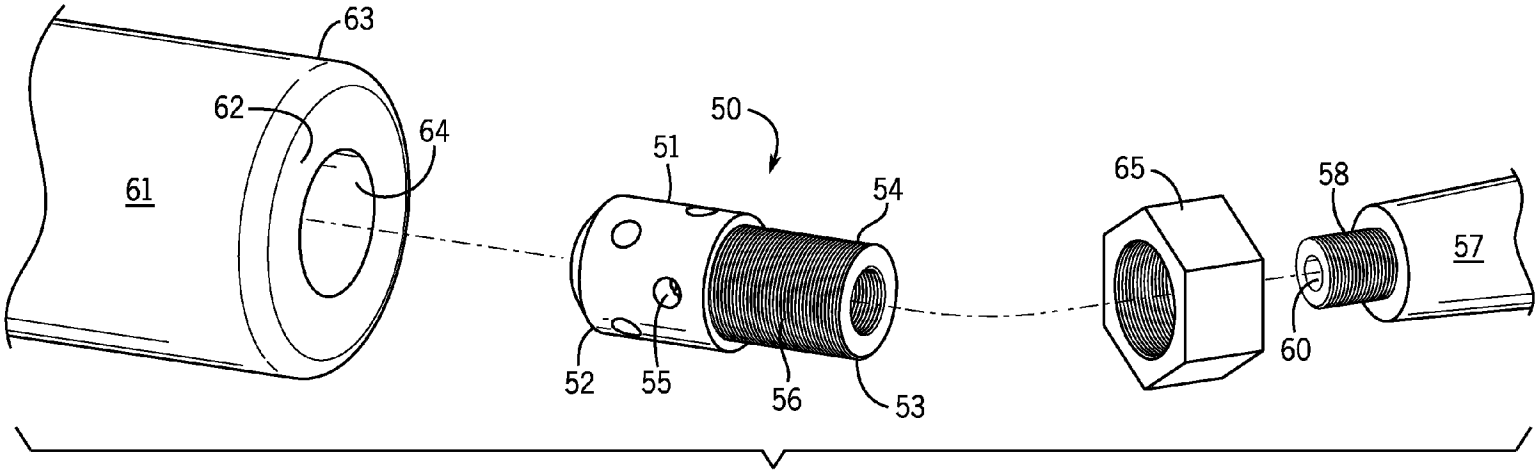
FIG. 7 shows an alternate embodiment of the gas dispersion nozzle positioned between a rifle barrel and gun silencer.

FIG. 5 shows a cutaway view of the gas dispersion nozzle 10 positioned in a gun silencer 18. The front end of silencer 18 has a cover 36 with an entrance/exit opening 37. The interior 21 has slant baffles 38 with entrance/exit openings 37. Also, the interior 21 has a blast baffle 39 positioned in front of the nozzle portion 11 and behind the slant baffles 38. The blast baffle 39 has angled grooves 40 around its circumference and has a rear side 41 with an entrance opening 42. The slant baffles 38 and blast baffle 39 are shown attached to the interior walls of the gun silencer 18. The blast baffle 39 is in front of the nozzle portion 11 and behind the slant baffles 38. The blast baffle 39 may also be connected to the front end 8 of the nozzle portion 11. FIG. 6 shows an enlarged view of the blast baffle 39 from the front side 43 which has an exit opening 44. Exit opening 44 has a greater diameter than entrance opening 42, forming a conical shaped interior 45 in blast baffle 39. When the propellant gases are expelled through the slanted grooves 40 they will rotate and/or create a vortex. This rotational flow further decreases the flow rate of the propellant gases.

When the gas dispersion nozzle 10 is used with a gun silencer it can increase the efficiency of the gun silencer in reducing sound and flash by 20% to 60%. When the blast baffle 39, with angled grooves 40, is used with a gun silencer it can increase the efficiency of the gun silencer in reducing sound and flash by 10% to 40%. When both the gas dispersion nozzle and 10 and the blast baffle 39 are used together with a gun silencer they can increase the efficiency of the gun silencer in reducing sound and flash by 30% to 90%. In addition, the combination of the gas dispersion nozzle 10 and the blast baffle 39 in the gun silencer can reduce the flow rate of propellant gases below the speed of sound as the propellant gases exit the front end of the silencer.

FIGS. 7, 8, 9, and 10 describe an alternate embodiment of the present invention. The gas dispersion nozzle 50 is shown positioned between a rifle barrel 57 and gun silencer 61 in FIG. 7. The gas dispersion nozzle 50 is cylindrical having walls 51 which define a hollow interior 69 (see FIG. 9). It has a front end 52 and a rear end 53. The rear portion 54 is a threaded extension having threads 56. The gas dispersion nozzle 50 has holes or channels 55 similar to those described for the gas dispersion nozzle 10, and may also have angled channels as shown in FIG. 2. The firearm barrel 57 has a threaded extension 58 an exit opening 60. The gun silencer 61 has a rear end 63 with a face 62. There is an opening 64 in face 62 and it is shown as off center in the face 62. However, the opening 64 can be placed in the center of face 62 if desired. The opening 64 has a diameter smaller than the diameter of the portion of the nozzle 50 that has holes 55 so that this portion of the nozzle 50 cannot pass through opening 64. The extension 54 on nozzle 50 has a diameter smaller than the diameter of opening 64 so extension 54 can pass through opening 64. Nut 65 screws onto threaded extension 54 and threaded extension 58 on firearm 57 screws into the threaded interior 68 (see FIG. 10) of threaded extension 54. This feature allows an eccentric silencer to be rotated to an optimal position, and then fixated into that position with a jam nut.

Figure 8:
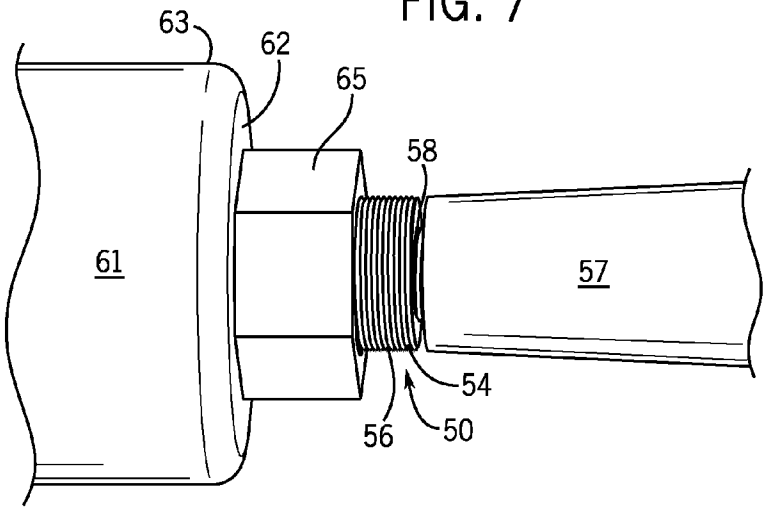
FIG. 8 shows the gas dispersion nozzle of FIG. 7 assembled with the gun silencer and the firearm barrel.
Figure 9:
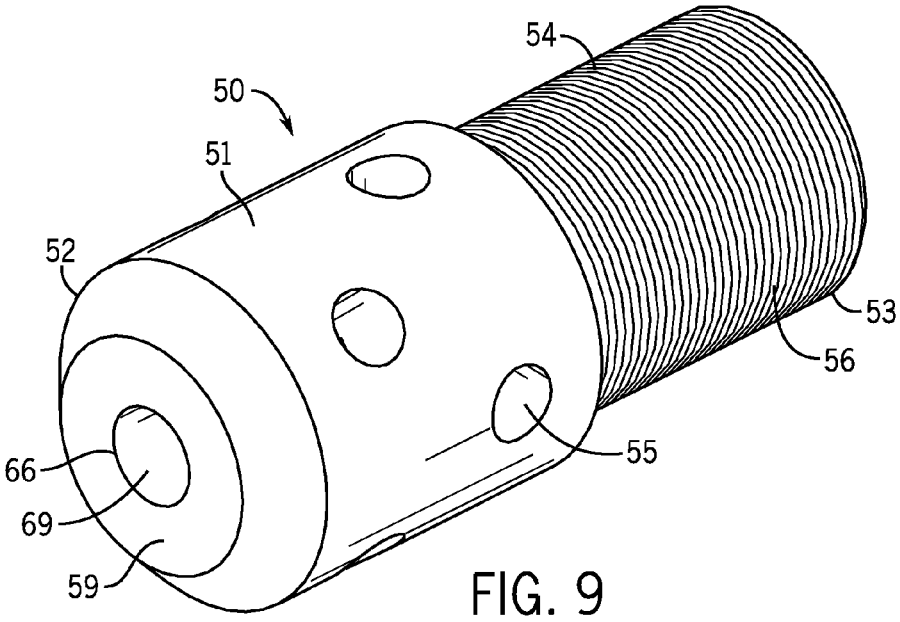
FIG. 9 shows a front perspective view of the gas dispersion nozzle of FIG. 7.
Figure 10:
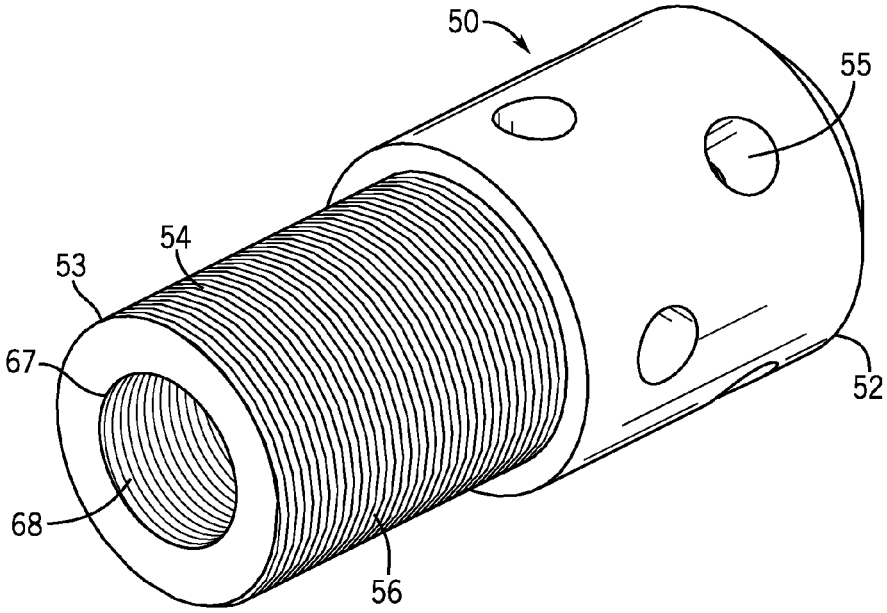
FIG. 10 shows a rear perspective view of the gas dispersion nozzle of FIG. 7.

FIG. 8 shows the gas dispersion nozzle 50 assembled with the gun silencer 61 and the firearm barrel 57. The nozzle 50 is inserted into the hollow interior of the gun silencer and the threaded extension 54 is passed through opening 64. Nut 65 is then screwed onto threaded extension 54, thereby reversibly attaching nozzle 50 to gun silencer 62 with the portion of the nozzle 50 having channels 55 being retained within the interior and at the rear 63 of gun silencer 62. The threaded extension 58 of firearm 57 is then screwed into the threaded interior 68 of the entrance opening 67 of nozzle 50. FIG. 9 shows a front perspective view of the gas dispersion nozzle 50, further showing the front face 59 and the exit opening 66 as well as the hollow interior 69 of the nozzle 50. FIG. 10 shows a rear perspective view of the gas dispersion nozzle 50, further showing the entrance opening 67 and the threaded interior 68 of nozzle 50.

The foregoing description has been limited to specific embodiments of this invention. It will be apparent, however, that variations and modifications may be made by those skilled in the art to the disclosed embodiments of the invention, with the attainment of some or all of its advantages and without departing from the spirit and scope of the present invention. For example, the gas dispersion nozzles of the present invention can be made of any suitable materials and can be used with any type of gun silencer and firearm. The gas dispersion nozzle can be made in any desired size. A combination of perpendicular and angled channels can be used in the nozzle. The angled channels and the angled grooves can rotate the propellant gases clockwise or counterclockwise. The gun silencer can be attached to the nozzles by methods well known in the art, including welding, soldering, threading, three-lug cam mounting system, etc. The gun silencer can be reversibly attached to the nozzles, for example, by threading.

It will be understood that various changes in the details, materials, and arrangements of the parts which have been described and illustrated above in order to explain the nature of this invention may be made by those skilled in the art without departing from the principle and scope of the invention as recited in the following claims.

I claim:

1. A gas dispersion nozzle for a firearm silencer, comprising:

a) a nozzle portion having a front end and a rear end and side walls enclosing a hollow interior therein through which hollow interior a projectile and propellant gases pass;

b) said rear end of said nozzle portion having a base portion to attach said nozzle portion to said firearm silencer and to extend said nozzle portion into an interior of said firearm silencer, wherein said base portion has an opening and walls enclosing a hollow interior therein through which a projectile and propellant gases pass, wherein said walls of said base portion have internal threads to attach said nozzle portion to a barrel of a firearm through said opening of said base portion, wherein said threads extend from said opening inward, and wherein only a threaded portion of said barrel is extendable into said hollow interior of said base portion; and c) said side walls of said nozzle portion having channels which direct the flow of said propellant gases out of said hollow interior at an angle to a path along which said projectile passes, wherein said channels are not perpendicular to the longitudinal axis of said hollow interior of said nozzle portion, thereby causing the flow of said propellant gases to be rotational and to create a vortex.

2. The gas dispersion nozzle of claim 1 wherein the external surface of said walls of said base portion are not tapered.

3. The gas dispersion nozzle of claim 1 further comprising an internal choke at said front end of said nozzle portion to direct said propellant gases into said channels.

4. The gas dispersion nozzle of claim 1 wherein said nozzle portion decreases a report and flash produced by a discharge of said firearm and eliminates a first round pop of said firearm when said nozzle portion is attached to said silencer.

5. A gas dispersion nozzle for a firearm silencer, comprising:

a) a nozzle portion having a front end and a rear end and side walls enclosing a hollow interior therein through which hollow interior a projectile and propellant gases pass;

b) said side walls having channels which direct the flow of said propellant gases out of said hollow interior at an angle to a path along which said projectile passes;

c) a hollow threaded extension attached to said rear end of said nozzle portion to attach said nozzle portion to said firearm silencer and to a barrel of a firearm; and d) said threaded extension extending outside of said silencer and attaching said nozzle portion to said firearm silencer by means of a nut outside said silencer, wherein said channels are not perpendicular to the longitudinal axis of said hollow interior of said nozzle portion, thereby causing the flow of said propellant gases to be rotational and to create a vortex, and thereby decreasing a report and flash produced by a discharge of said firearm and eliminating a first round pop of said firearm when said nozzle portion is attached to said silencer.

6. A gas dispersion nozzle for a firearm silencer, comprising:

a) a nozzle portion having a front end and a rear end and side walls enclosing a hollow interior therein through which a projectile and propellant gases pass;

b) said rear end of said nozzle portion having a base portion to attach said nozzle portion to said firearm silencer and to extend said nozzle portion into an interior of said firearm silencer, wherein said base portion has an opening and walls enclosing a hollow interior therein through which a projectile and propellant gases pass, wherein said walls of said base portion have internal threads to attach said nozzle portion to a barrel of a firearm through said opening of said base portion, wherein said threads extend from said opening inward, and wherein only a threaded portion of said barrel is extendable into said hollow interior of said base portion; and c) said side walls of said nozzle portion having channels which direct the flow of said propellant gases out of said hollow interior at an angle to a path along which said projectile passes, wherein said channels are not perpendicular to the longitudinal axis of said hollow interior of said nozzle portion, thereby causing the flow of said propellant gases to be rotational and to create a vortex, wherein said nozzle portion decreases the report and flash produced by the discharge of said firearm, and wherein said nozzle portion eliminates a first round pop of said firearm when said nozzle portion is attached to said silencer.

7. The gas dispersion nozzle of claim 6 wherein the external surface of said walls of said base portion are not tapered.

8. The gas dispersion nozzle of claim 6 further comprising an internal choke at said front end of said nozzle portion to direct said propellant gases into said channels.

9. A gas dispersion nozzle for a firearm silencer, comprising:

a) a nozzle portion having a front end and a rear end and side walls enclosing a hollow interior therein through which a projectile and propellant gases pass;

b) said rear end of said nozzle portion having a base portion to attach said nozzle portion to said firearm silencer and to extend said nozzle portion into an interior of said firearm silencer, wherein said base portion has an opening and walls enclosing a hollow interior therein through which a projectile and propellant gases pass, wherein said walls of said base portion have internal threads to attach said nozzle portion to a barrel of a firearm through said opening of said base portion, wherein said threads extend from said opening inward, and wherein only a threaded portion of said barrel is extendable into said hollow interior of said base portion;

c) said side walls of said nozzle portion having channels which direct the flow of said propellant gases out of said hollow interior of said nozzle portion at an angle to a path along which said projectile passes, wherein said channels are not perpendicular to the longitudinal axis of said hollow interior of said nozzle portion, thereby causing the flow of said propellant gases to be rotational and to create a vortex, and wherein said nozzle portion eliminates a first round pop of said firearm when said nozzle portion is attached to said silencer; and d) an internal choke at said front end of said nozzle portion to direct said propellant gases into said channels of said nozzle portion, wherein said nozzle portion decreases the report and flash produced by the discharge of a firearm, and wherein the external surface of said walls of said base portion are not tapered.

10. A gas dispersion nozzle for a firearm silencer, comprising:

a) a nozzle portion having a front end and a rear end and walls enclosing a hollow interior therein through which a projectile and propellant gases pass;

b) said rear end of said nozzle portion having a hollow threaded extension attached thereto to attach said nozzle portion to said firearm silencer and to extend said nozzle portion into an interior of said firearm silencer, and to attach said nozzle portion to a barrel of a firearm;

c) said walls having channels which direct the flow of said propellant gases out of said hollow interior at an angle to a path along which said projectile passes, wherein said channels are not perpendicular to the longitudinal axis of said hollow interior of said nozzle portion, thereby causing the flow of said propellant gases to be rotational and to create a vortex;

d) an internal choke at said front end of said nozzle portion to direct said propellant gases into said channels; and e) said threaded extension extending outside of said silencer and attaching said nozzle portion to said firearm silencer by means of a nut outside said silencer.

11. The gas dispersion nozzle of claim 10 wherein said nozzle portion decreases a report and flash produced by a discharge of said firearm and eliminates a first round pop of said firearm when said nozzle portion is attached to said silencer.

12. The gas dispersion nozzle of claim 10 wherein said threaded extension allows extension of said nozzle portion into said interior of said firearm silencer off center of said interior of said firearm silencer.

13. A gas dispersion nozzle for a firearm silencer, comprising:

a) a nozzle portion having a front end and a rear end and walls enclosing a hollow interior therein through which a projectile and propellant gases pass;

b) said rear end of said nozzle portion having a hollow threaded extension attached thereto to attach said nozzle portion to said firearm silencer and to extend said nozzle portion into an interior of said firearm silencer, and to attach said nozzle portion to a barrel of a firearm;

c) said walls having channels which direct the flow of said propellant gases out of said hollow interior at an angle to a path along which said projectile passes, wherein said channels are not perpendicular to the longitudinal axis of said hollow interior of said nozzle portion, thereby causing the flow of said propellant gases to be rotational and to create a vortex, and wherein said nozzle portion decreases a report and flash produced by a discharge of said firearm and eliminates a first round pop of said firearm when said nozzle portion is attached to said silencer; and d) an internal choke at said front end of said nozzle portion to direct said propellant gases into said channels, wherein said threaded extension extends outside of said silencer and attaches said nozzle portion to said firearm silencer by means of a nut outside said silencer.

14. The gas dispersion nozzle of claim 13 wherein said threaded extension allows extension of said nozzle portion into said interior of said firearm silencer off center of said interior of said firearm silencer.

15. A gas dispersion nozzle for a firearm silencer, comprising:

a) a nozzle portion having a front end and a rear end and side walls enclosing a hollow interior therein through which a projectile and propellant gases pass;

b) said rear end of said nozzle portion having a base portion attached thereto and attached to said firearm silencer, thereby extending said nozzle portion into an interior of said firearm silencer, wherein said base portion has an opening and walls enclosing a hollow interior therein through which a projectile and propellant gases pass, wherein said walls of said base portion have internal threads to attach said nozzle portion to a barrel of a firearm through said opening of said base portion, wherein said threads extend from said opening inward, and wherein only a threaded portion of said barrel is extendable into said hollow interior of said base portion;

c) said side walls of said nozzle portion having channels which direct the flow of said propellant gases out of said hollow interior of said nozzle portion at an angle to a path along which said projectile passes, and into an interior of said firearm silencer, wherein said channels are not perpendicular to the longitudinal axis of said hollow interior of said nozzle portion, thereby causing the flow of said propellant gases to be rotational and to create a vortex;

d) said interior of said firearm silencer having one or more slant baffles and one or more blast baffles; and e) said blast baffle having a plurality of angled, linear, and parallel grooves that extend through said blast baffle and around the circumference of said blast baffle to cause the flow of said propellant gases to be rotational and to create a vortex, thereby decreasing the flow rate of said propellant gases through said interior of said firearm silencer.

16. The gas dispersion nozzle of claim 15 wherein the external surface of said walls of said base portion are not tapered.

17. The gas dispersion nozzle of claim 15 further comprising an internal choke at said front end of said nozzle portion to direct said propellant gases into said channels of said nozzle portion, wherein said gas dispersion nozzle, said blast baffle, and said slant baffles decrease the report and flash produced by a discharge of said firearm and eliminate a first round pop of said firearm when said nozzle portion is attached to said silencer.

18. A gas dispersion nozzle for a firearm silencer, comprising:

a) a nozzle portion having a front end and a rear end and walls enclosing a hollow interior therein through which a projectile and propellant gases pass;

b) said rear end of said nozzle portion having a hollow threaded extension attached thereto attaching said nozzle portion to said firearm silencer and extending said nozzle portion into an interior of said firearm silencer, and constructed to attach said nozzle portion to a barrel of a firearm, wherein said threaded extension extends outside of said silencer and attaches said nozzle portion to said firearm silencer by means of a nut outside said silencer;

c) said walls having channels which direct the flow of said propellant gases out of said hollow interior at an angle to a path along which said projectile passes and into said interior of said firearm silencer, wherein said channels are not perpendicular to the longitudinal axis of said hollow interior of said nozzle portion, thereby causing the flow of said propellant gases to be rotational and to create a vortex within said interior of said firearm silencer;

d) said interior of said firearm silencer having one or more slant baffles and one or more blast baffles; and e) said blast baffle having a plurality of angled, linear, and parallel grooves that extend through said blast baffle and around the circumference of said blast baffle to cause the flow of said propellant gases to be rotational and to create a vortex, thereby decreasing the flow rate of said propellant gases through said interior of said firearm silencer.

19. The gas dispersion nozzle of claim 18 wherein the flow rate of said propellant gases is below the speed of sound as said propellant gases exit said firearm silencer.

20. The gas dispersion nozzle of claim 18 further comprising an internal choke at said front end of said nozzle portion to direct said propellant gases into said channels of said nozzle portion, wherein said gas dispersion nozzle, said blast baffle, and said slant baffles decrease the report and flash produced by a discharge of said firearm and eliminate a first round pop of said firearm when said nozzle portion is attached to said silencer.

21. The gas dispersion nozzle of claim 18 wherein said threaded extension allows extension of said nozzle portion into said interior of said firearm silencer off center of said interior of said firearm silencer.

22. A gas dispersion nozzle for a firearm silencer, comprising:

a) a nozzle portion having a front end and a rear end and walls enclosing a hollow interior therein through which a projectile and propellant gases pass;

b) said rear end of said nozzle portion having a threaded extension attached thereto attaching said nozzle portion to said firearm silencer and extending said nozzle portion into an interior of said firearm silencer, and constructed to attach said nozzle portion to a barrel of a firearm, wherein said threaded extension extends outside of said silencer and attaches said nozzle portion to said firearm silencer by means of a nut outside said silencer;

c) said walls having channels which direct the flow of said propellant gases out of said hollow interior at an angle to a path along which said projectile passes and into said interior of said firearm silencer, wherein said channels are not perpendicular to the longitudinal axis of said hollow interior of said nozzle portion, thereby causing the flow of said propellant gases to be rotational and to create a vortex within said interior of said firearm silencer;

d) said interior of said firearm silencer having one or more slant baffles and one or more blast baffles;

e) said blast baffle having a plurality of angled, linear, and parallel grooves that extend through said blast baffle and through a perimeter of said blast baffle to cause the flow of said propellant gases to become rotational, thereby decreasing the flow rate of said propellant gases through said interior of said firearm silencer, wherein the flow rate of said propellant gases is below the speed of sound as said propellant gases exit said firearm silencer; and f) an internal choke at said front end of said nozzle portion to direct said propellant gases into said channels of said nozzle portion, wherein said gas dispersion nozzle, said blast baffle, and said slant baffles decrease a report and flash produced by a discharge of said firearm and eliminate a first round pop of said firearm when said nozzle portion is attached to said silencer.

* * * * *